US005749721A

United States Patent [19]

Klinge et al.

[11] Patent Number: 5,749,721

[45] Date of Patent: May 12, 1998

[54] CERAMIC COMBUSTION SUPPORT ELEMENT FOR SURFACE BURNERS AND PROCESS FOR PRODUCING THE SAME

[75] Inventors: Bernd Klinge, Leipzig; Michael Gutknecht, Dassendorf; Bernd Weise, Berlin; Ingo Birnkraut, Hamburg, all of Germany

[73] Assignee: Gossler Thermal Ceramics GMBH, Reinbek/Hamburg, Germany

[21] Appl. No.: 592,429

[22] PCT Filed: Jul. 22, 1994

[86] PCT No.: PCT/EP94/02419

§ 371 Date: May 29, 1996

§ 102(e) Date: May 29, 1996

[87] PCT Pub. No.: WO95/03511

PCT Pub. Date: Feb. 2, 1995

[30] Foreign Application Priority Data

Jul. 22, 1993 [DE] Germany ..... 43 24 644.3

[51] Int. Cl.[6] ..... F23D 14/12

[52] U.S. Cl. ..... 431/328

[58] Field of Search ..... 431/328, 329

[56] References Cited

U.S. PATENT DOCUMENTS

| | | | |
|---|---|---|---|
| 1,830,826 | 11/1931 | Cox | 431/328 |
| 3,179,156 | 4/1965 | Weiss et al. . | |
| 3,208,247 | 9/1965 | Weil et al. . | |
| 3,275,497 | 9/1966 | Weill et al. . | |
| 3,322,179 | 5/1967 | Goodell . | |
| 3,912,443 | 10/1975 | Ravault et al. | 431/328 |
| 4,039,480 | 8/1977 | Watson et al. . | |
| 4,189,294 | 2/1980 | Rice et al. . | |
| 4,416,619 | 11/1983 | Craig et al. . | |
| 4,519,770 | 5/1985 | Kesselring et al. . | |
| 4,533,318 | 8/1985 | Buehl . | |
| 4,599,066 | 7/1986 | Granberg . | |
| 4,605,369 | 8/1986 | Buehl . | |
| 4,643,667 | 2/1987 | Fleming . | |
| 4,673,349 | 6/1987 | Abe et al. . | |
| 4,721,456 | 1/1988 | Granberg et al. . | |
| 4,814,300 | 3/1989 | Helferich . | |
| 4,889,481 | 12/1989 | Morris et al. . | |
| 5,249,953 | 10/1993 | Roth et al. . | |
| 5,356,487 | 10/1994 | Goldstein et al. | 431/328 |

FOREIGN PATENT DOCUMENTS

| | | |
|---|---|---|
| 25742 | 2/1969 | Australia . |
| 0056757 | 7/1982 | European Pat. Off. . |
| 0157432A2 | 10/1985 | European Pat. Off. . |
| 0187508A3 | 7/1986 | European Pat. Off. . |
| 0227131A1 | 7/1987 | European Pat. Off. . |
| 0382674A3 | 8/1990 | European Pat. Off. . |
| 0390255A1 | 10/1990 | European Pat. Off. . |
| 0397591A1 | 11/1990 | European Pat. Off. . |
| 0410569A1 | 1/1991 | European Pat. Off. . |
| 0530630A1 | 3/1993 | European Pat. Off. . |
| 2222329 | 10/1974 | France . |
| 1303596 | 5/1972 | Germany . |
| 3311953A1 | 10/1984 | Germany . |
| 3504601A1 | 8/1985 | Germany . |
| 3444398 | 2/1986 | Germany . |
| 4041061A1 | 6/1991 | Germany . |
| 62-258917 | 11/1987 | Japan . |
| WO84/04376 | 11/1984 | WIPO . |

*Primary Examiner*—Carroll B. Dority

*Attorney, Agent, or Firm*—Fitzpatrick, Cella, Harper & Scinto

[57] ABSTRACT

Combustion support element (E), in particular for quasi-flameless surface burners, consisting of a ceramic material having a plurality of throughflow openings, the ceramic material is a porous, hollow-ball-like conglomeration ceramic, preferably formed as a two, three of more layer composite ceramic.

33 Claims, 1 Drawing Sheet

CERAMIC COMBUSTION SUPPORT ELEMENT FOR SURFACE BURNERS AND PROCESS FOR PRODUCING THE SAME

BACKGROUND OF THE INVENTION

1. Field of the Invention

The invention relates to a ceramic combustion support element, preferably in the form of a ceramic composite body in surface radiant burners for industrial conversion and heating processes in the temperature range up to in particular approximately 1300° C., and a process for producing the same.

2. Description of the Related Art

Surface radiant burners in many forms are employed in particular for space heating and drying purposes in the infra-red range and as low-pollution combustion units in the heating and boiler field. Here above all, the possibility of a low-pollution operation at operating temperatures up to 1000° C. are exploited.

In general, a distinction can be made between two basic types, namely multi-flame surface burners and quasi-flameless surface burners.

Multi-flame burners are distinguished in that, from the burner surface, many individual flames form which in particular performance ranges can unite into a flame front.

Inter alia, stable perforated or slitted flame support elements are employed in order to improve working life relative to metallic flame supports, such as for example described in DE-A-40 41 061, from which there can be understood a ceramic combustion support element over which the present invention is an improvement. For reasons of safety with regard to flareback, the removal of heat remains relatively small. Nitrogen oxide formation is greater than in comparable quasi-flameless surface burners. The working range is additionally restricted through a higher CO and CxHy component. This is the case also for ceramics which are porous in the manner of a conglomeration of ceramics particles bound together in a manner which forms or leaves interstices, as for example described in EP-A-0 056 757. The binders employed here, clay or bentonite, allow there to be expected a sufficient working life in cyclical operation, with the necessary flareback security, only with small temperature drops over the layer thickness of the ceramics. Additionally, with the described low pressure loss of the ceramic in the case of a cylindrical form closed at one end, a factor is an expected unevenness of the flame distribution with increased energy transport towards the closed head end.

The quasi-flameless surface burners form a second group. With this burner type, in a certain performance range, the flame roots sit in the surface layer of the combustion support and cause this to glow. Through the removal of considerable proportions of radiative heat, the combustion temperature of the fuel-air mixture lead through the flame support, and the NOx-formation, is markedly suppressed. Above a certain burner power and at high combustion air excess, with these burners also the flame detaches itself from the surface and causes a deterioration in the exhaust cleanliness. A significant form of this burner type is based on radiative combustion elements of ceramic fibers, which are deposited by means of vacuum forming together with binders preferably on a metal sieve. Configurations of this form are described for example in EP-A-0 382 674, EP-A-0 397 591; U.S. Pat. No. 4,416,619; DE-A-3 311 953; U.S. Pat. No. 3,179, 156; U.S. Pat. No. 3,275,497 and U.S. Pat. No. 4,519,770.

The flame support proposals described in EP-A-0 382 674 and EP-A-0 397 591 permit only a vary narrow control range to be expected. The thick fiber layer, bonded in accordance with the description with alumina coating, is mechanically fragile, in particular sensitive to any handling, to vibration and tends increasingly to erosion with the thermal aging process. The closed burner head form means that there is to be expected a build-up effect with uneven distribution of flames on the ceramic coating and therewith a deterioration of the exhaust cleanliness and increased erosion of fibers in this region (hot-spot formation).

In general, the binder structure with the desired gamma and theta phases of $Al_2O_3$ as main binder component, as described in U.S. Pat. No. 4,416,619 and DE-A-3 331 953, sets limits both for the heat treatment for removal of the pore former and also for the later operating temperature of the fiber ceramics, which limits lie at approximately 1100° C. Gaseous chemical effects are less decisive, unless the large surface area of the gamma and theta phases is needed in conjunction with catalytic supplements. Here, the embrittlement of the surface layer through phase transition of the $Al_2O_3$ into the alpha phase, above approximately 982.2° C. (see DE-A-3 311 953) is important. Additionally, in the case of use of amorphous aluminium silicate fibers of the type described for example in U.S. Pat. No. 3,179,156 and U.S. Pat. No. 3,275,497 the recrystallization thereof is an additional consideration. Related to the formation of preferred dispositions of the fibers, caused by the vacuum forming, with extended operation at round 1000° C. and above there is to be expected the formation of cracks, even to the extent that there is a danger of rupture, in the embrittled fiber surface which forms.

The measures proposed, especially in DE-A-3 311 953 and U.S. Pat. No. 4,416,619, for the pre-grooving of the surface are intended to prevent longer cracks and flaking off of larger pieces, but in the long term in themselves represent preferred locations for crack growth and erosion.

A further disadvantage of this ceramic is the tendency to point erosion at weak points and in regions of increased pressure, in particular in the head region of the cylinder closed at one end. The hot-spot formation which takes place becomes more pronounced with thermal aging and causes deterioration of the otherwise initially very favourable exhaust cleanliness of this burner type with regard to NOx, CO and CxHy content and negatively effects the burner starting behaviour.

Radiation burners based on ceramic fiber weaves as flame supports on porous metal carriers, as described in U.S. Pat. No. 4, 599,066; U.S. Pat. No. 4,721,456 or for example in DE-A-3 504 601, attempt to avoid the disadvantages of vacuum formed fiber ceramics with regard to hardness and long term stability.

At high powers and high operating temperatures the attachment of the fiber weave to the metal screen becomes problematic as a result of self expansion. Localized occurrences of lifting off of the fiber material, with the danger of flareback, are unavoidable. The improvement striven for with U.S. Pat. No. 4,721,456 involves metallic attachment elements which restrict the operational temperature and do not prevent possible pressure and power dependent changes of the pore form over longer operational periods and cycles.

Metallic fiber radiation burners, as described for example in EP-A-0 157 432, EP-A-0 227 131 and EP-A-0390 255, have mechanical advantages but have, due to the materials employed, an operational limit of 1150° C. surface temperature, are very expensive because of the necessary high quality special steel fiber properties and are to be expected to be more susceptible to heat corrosion than ceramics in the case of critical exhaust gas components such as for example hydrogen halides.

EP 0 187 508 A3 relates to a combustion support element that consists of a porous combustion body made by forming and sintering a starting material of ceramics powder, binder and inorganic fibers, which in addition to its porosity has a plurality of preferably bored through holes, see in particular page 5, last paragraph to page 7, first paragraph.

EP-A-0 410 569 A1 relates to a plate-like porous combustion body which is carried by a metal sieve and consists of two blocks extending transversely of the throughput direction, of which the second block has a porosity with larger through openings. An explanation relating to the actual flow resistance is not given. The second block may be coated or impregnated with metal oxide, see column 7, lines 45 to 55.

EP-A-0 530 630 A1 discloses a porous combustion body having a plurality of zones in which the structure or porosity becomes finer from the interior towards the exterior. An explanation relating to the actual flow resistance cannot be found in this publication either.

From AU-B-25742/67 there can be understood a porous combustion body, which for the avoidance of flareback has a porous layer formed by means of the application of a slip having aluminium powder and fibers.

FR-A-2 222 329 relates to a porous combustion body with differing flow resistance so that in operation a pilot flame is provided.

In WO-A-84 04376 there is described a porous combustion body containing fibers, the outer surface of which is sealed, see in particular page 5, last paragraph.

From U.S. Pat. No. 3,208,247 there is described a plate-like, sleeve-like or ball-like porous combustion body of foam-like or fibrous structure, which may be coated at its combustion surface, see in particular column 3. In lines 16 to 28 there is described a burn-out material for improving the porous structure.

U.S. Pat. No. 4,189,294 relates to flameless combustion in a catalytic zone and is to be regarded as more distant state of the art.

In U.S. Pat. No. 4,889,481 there are described a plate-like or sleeve-like porous combustion body of ceramic material, whereby the body has two layers of differing porosities, see column 4, line 22. Further, the external end surface of the first layer, and in substance all surfaces of the second layer, may be provided with a ceramic coating, see abstract.

From U.S. Pat. No. 4,814,300 there can be understood a molded body of porous ceramic material consisting of a foamable initial material with a mixture of alkali silicates, alkali aluminates and ceramic particles. This is a porous body for various purposes, inter alia also combustion ovens.

U.S. Pat. No. 4,643,667 describes a porous combustion body consisting of two layers of which the first layer has a lower heat conductivity and the second layer a higher heat conductivity. Further, the two layers are of different porosities, see column 5, line 25 and following.

From U.S. Pat. No. 3,322,179 there can be understood a porous combustion body which consists of substantially ball-like particles, the size of the particles increasing from the interior to the exterior. The particles are baked together (sintered), see column 4, last paragraph, and they may have a catalytic coating.

In the abstract of Japanese patent publication JP-A-62 258 917 there is described a porous combustion body which consists of ball-like ceramic particles which are, by means of a binder, bound to one another to form a solid body.

In U.S. Pat. No. 4,039,480 there is described a process for the production of substantially ball-like pellets and their application as catalyst. The ball-like pellets contain a combustible material and they are coated on the exterior with a ceramic powder. Because of this coating, they can be sintered together under the effect of heat, the combustible material being burned out and hollow ceramic balls being formed. The ceramic may be an aluminium silicate such as mullite.

SUMMARY OF THE INVENTION

The object of the invention is to provide a combustion support element which, whilst affording great resistance to corrosion, stability and working life, on the one hand makes possible a good throughflow for the combustion material and on the other hand makes possible a good and disruption free combustion also at high temperatures, in particular up to approximately 1300° C.

The invention further has the object to attain, in an adequate power range of at least 1:2.5, a high quality combustion with minimal formation of NOx and substantially complete avoidance of the formation of CO and CxHy.

Further, the object of the invention is to provide a combustion support element which can be manufactured simply and economically with satisfactory porosity and thermal and mechanical stability.

Furthermore, the invention has the object of configuring a combustion support element so that there arises at its combustion surface a definite, especially an even, outflow speed profile or flame distribution.

It is further another goal of the invention to provide a combustion support element which, whilst maintaining a simple configuration, allows a simple mounting of the combustion support element with low installation or mounting effort in a burner.

The combustion support element according to the invention has a porous, ball-like or hollow-ball-like conglomeration ceramic. Such a conglomeration ceramic can be manufactured simply and economically and moreover leads to an advantageous porosity and a disturbance free and even gas throughflow, with satisfactory strength. The combustion support element in accordance with the invention can serve as secondary mixer, and mixture distributor for the fuel-air mixture flowing through. Because of the porous conglomeration ceramic present, the combustion support element has a sufficient flow resistance to prevent flareback. Furthermore, the porosity is of satisfactory uniformity which leads to a largely uniform flow speed profile. Further, it is advantageous to pre-sinter the ceramic in accordance with the invention, at least up to such a temperature that it has adequate strength to function as a flame carrier of long working life.

The combustion support element and the multi-layer ceramic combustion support element according to this invention are suitable both for multi-flame surface burners and for quasi-flameless surface burners, the combustion support element being particularly suitable for a quasi-flameless surface burner in particular because the second and a further layer arranged on the outflow side favours the retention of the bases of the flames in its surface layer. Because of the formation of this combustion support element as a composite part, the combustion support element in accordance with the invention is not only of great thermal but also mechanical stability.

A embodiment in accordance with the invention as above described improves gas outflow, whereby the danger of flarebacks is removed or at least greatly reduced.

With surface burners without particular flow guiding and distribution devices it is determined that there arise in the center of the fuel flow, on the outflow side, higher flow speeds—which leads to a non-uniform flame formation. This disadvantage is removed by means of the configuration in accordance with a specific aspect of the invention.

The influencing of the structural layer formation, achievable by means of the features in accordance with the invention, can be effected through the combination of a gas driving process with a burn-out process, whereby there is achieved an open macro-and micro-pore spectrum in the range of equivalent pore diameter from greater than 0 to about 1 mm in the layers, which is favourable from the point of view of combustion characteristics, and at the same time a multi directional bonding (reinforcement) of the material conglomeration by means of fiber materials is effected, which very positively influences the temperature change resistance of the layers.

The configurations in accordance with the invention are suitable both for a disk-like form and for a sleeve-like or pot-like form of the combustion support element.

The process leads not only to the advantages already mentioned but also makes possible a simple and economical manufacture of the combustion support element and further favours its properties with regard to porosity, strength, heat radiation and working life.

By means of the invention there is provided a flame support ceramic for a quasi-flameless gas radiative burner, preferably working in accordance with the pre-mixing principle, which preferably together with exhaust gas afterburning makes possible heat generation and heat treatment processes up to 1300° C., thereby additionally allowing the use of a hydrocarbon containing exhausts as fuels directly or at lower concentration as combustion air, in which case a useable combustion gas, e.g. natural gas, is to be mixed in, and with appropriate selection of material furthermore provides for the reliable thermal afterburning of halogen containing components in the exhaust.

Further, by means of the invention there are avoided, in the flame support region, corrosion sensitive, fine, metallic constructional elements, such as for example sieve weaves, fine hole weaves, fine hole sheets and metal fiber material.

As will be seen from the following description, the invention include mor specific aspects which provide the basis for a full exploitation of the advantages of the invention.

In addition, as further described herein, certain configurations in accordance with the invention serve for the improvement of the sealing of the combustion support element in its mounting region.

The combustion support element in accordance with the invention and the process in accordance with the invention are suitable preferably for a multi-layer composite ceramic, having three layers.

BRIEF DESCRIPTION OF THE DRAWINGS

Below, the invention and further advantages which can be achieved thereby will be explained in more detail with reference to preferred exemplary embodiments and with reference to the drawings, which show.

DETAILED DESCRIPTION OF THE PREFERRED EMBODIMENTS

With all the above-described exemplary embodiments, the combustion support element E consists of three layers, 1, 2, and 3, which with reference to the throughflow direction lie transversely one upon another and form a composite body. The fuel-air mixture flow, on the inflow side, is indicated by 4. In combustion operation of the combustion support element E, the fuel-air mixture forms at the outflow side combustion surface 5 of the third layer 3 a flame front 6, which is schematically indicated only in FIGS. 1 and 4, the outflow speed profile of which is uniform, as is made clear by the small arrows in the flame front 6.

Figure 1:
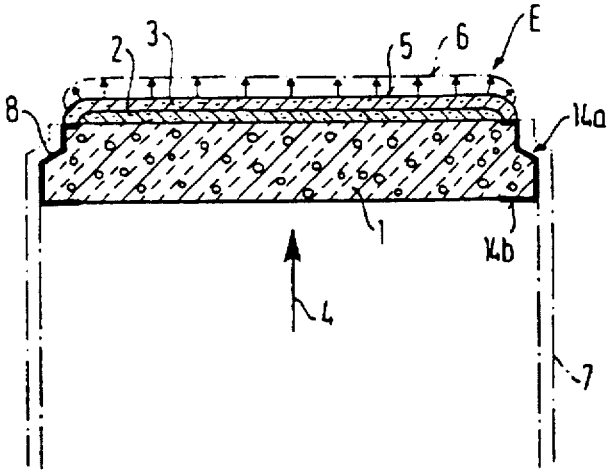
Fig. 1 is an elevational view, taken in section and showing a disk-like combustion support element in accordance with the invention.
Figure 2:
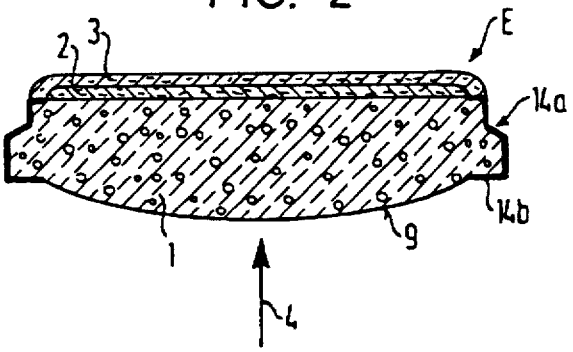
FIGS. 2 and 3 are views similar to FIG. 1 but showing modified configurations of the combustion support element of the present invention.
Figure 3:
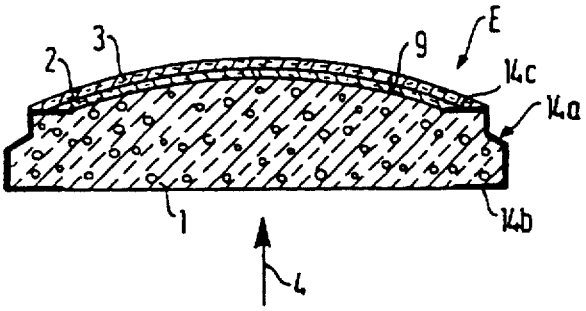

With the exemplary embodiments according to FIGS. 1 to 3, a pipe-like holder 7 can serve for mounting the combustion support element E, which holder surrounds the combustion support element E at its periphery. Preferably, the combustion support element E is tapered in step-form or conically towards the outflow side, whereby a step surface 8 is formed behind which the holder 7 can engage in order to prevent an unintended sliding of the combustion support element out of the holder 7.

The fuel-air mixture 4 is lead to the combustion support element E on the inflow side, e.g. in the holder 7, and thereby there arises in the centre of the flow 4 an increased backup pressure which without particular guide devices leads on the outflow side to an increased outflow speed profile in this region. In such a case, in order to obtain an even outflow speed profile, for example the flow resistance of the combustion support element E may be formed greater in the center than in the region surrounding the center, whereby the degree of gas permeability increases progressively radially. This can be achieved for example by means of a differing porosity.

With the exemplary embodiments according to FIGS. 2 and 3, this differing gas permeability is provided by means of a progressively increased thickness of the layer 1 towards the centre. With the exemplary embodiment according to FIG. 2, the layer 1 is thickened in the centre on the inflow side, preferably in the manner of a bulge or arch 9. In the exemplary embodiment according to FIG. 3, such a thickening is provided on the outflow side at the layer 1, likewise preferably by means of a bulge or arch 9. The layers 2 and 3 are in substance uniformly thick and adapted to the thickening of the layer 1 so that in accordance with FIGS. 1 and 2 the layers 2 are formed flat up to the edge of the layer 3 and in accordance with FIG. 3 are formed bulged.

Figure 4:
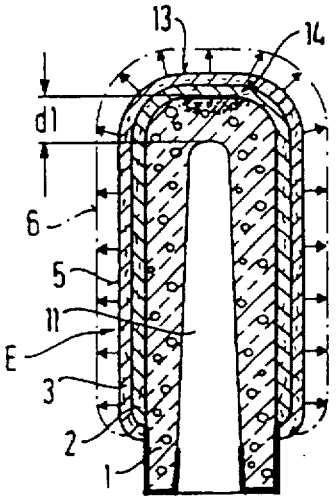
FIG. 4 is an elevational view, taken in section, of a sleeve-like combustion support element in accordance with the invention.
Figure 5:
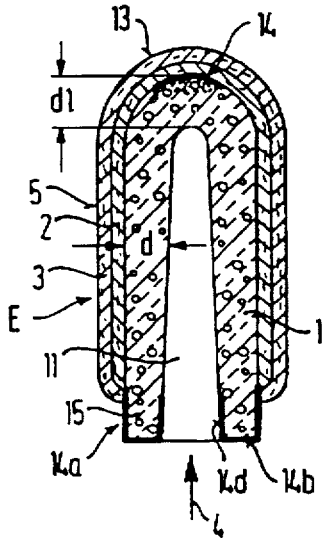
FIG. 5 is an elevational view, taken in section, of a modified sleeve-like combustion support element in accordance with the invention.

A similar problem occurs with a sleeve or pot-like combustion support element according to FIGS. 4 and 5. With such a shape, the increased flow pressure arises in the forward region of the combustion support element, in accordance with physical law.

In order to attain a uniform outflow speed profile 6 with a sleeve-like combustion support element E, at its peripheral surface, the hollow space 11 is convergent, in particular conical, towards the outflow side, so that with a cylindrical shape of the outer surface 12 of the first layer 1 there is provided a thickness d for the first layer 1 which diverges towards the outflow side.

With a configuration of the combustion support element E in the sense of a sleeve closed at the outflow side in accordance with FIGS. 4 and 5, the above-described flow pressure in the forward region of the space 11 likewise leads to an increase outflow speed profile at the end face 13 flattened off with rounded corners (FIG. 4) or at the end face 13 rounded in the shape of a hemisphere (FIG. 5) of the combustion support element E. In order also to obtain an even outflow speed profile at the end face 13, the first layer 1 may have a thickness d1 which is greater than the thickness d in the region of the first layer 1 joining rearwardly thereto. The forward end of the space 11 is, with regard to its shape, adapted to the external form of the first layer 1.

As is shown by FIGS. 4 and 5, such an alteration of flow, in particular a reduction, can be achieved also by means of a densified region 14 of the first layer 1 in the end region towards the end face. Such a densified region 14 can be provided by means of a more or less dense coating or covering with a suitable substance. Thereby, such substance may not merely cover over the layer 1 but may also penetrate into the layer 1. With the configuration according to FIGS. 4 and 5, such a densified region 14 is in each case provided externally on the layer 1 in the central region of the combustion support element E and covered over by the second layer 2. Such a covering or such a densification need not be completely sealing, it may also have a lesser porosity or gas permeability than the first layer 1.

In order to improve sealing to the holder 7 in the retention region of the combustion support element E, using simple means, and thus to avoid a transversely directed leakage flow at the holder 7, in each case the peripheral surface or mounting surface surrounded by the holder 7 is sealed in the sense of an above-described densified region, so that in this surface region it is not possible for the fuel-air mixture to exit. This densified region 14a extends up to the second layer 2, to the third layer 3. Preferably, the densified region **14*a* extends at the rear of the first layer 1 also radially inwardly by a few millimetres. This radial section is indicated by 14*b*. If appropriate, a corresponding radial section 14*c* may also be arranged on the outflow side on the first layer 1 as is shown in particular by FIG. 3. In such a case, the second layer 2 and the third layer 3 may cover over the section 14*c***.

In comparable manner, the inflow side mounting region is also provided with a densified region **14*a* in the case of a sleeve-like layer 1, as shown in FIGS. 4 and 5. Here, the sleeve-like layer 1 extends beyond the layer 2, and the layer 3, on the inflow side by a section 15 as needed for mounting, whereby the outer surface of this section 15 is sealed in the manner of the densified region 14*a*. Preferably, the densified region 14*a* extends not only with a radial section 14*c* at the outflow side end face of the first layer 1, but also with a section 14*d* on the internal wall of the space 11**.

An above-described seal 14 or **14*a*** is preferably a slick coating.

Preferred layer thicknesses are for layer 1 between about 10 and 50 mm, for the second layer 2 between about 1 and 4 mm and for the third layer 3 between about 1 and 4 mm depending upon the kind of fuel, the power, the constructional form and the available pressure of the fuel/air mixture. The particularly preferred layer thicknesses are 1.5 mm to 2.5 mm for the second layer 2 and 1 to 2 mm for the third layer 3. In particular in a performance region from about 150 $kW/m^2$ to about 400 $kW/m^2$ (applied fuel power referred to the surface of the combustion support element) and mixture supply pressures of about 20 to 80 mm head of water, referred to natural gas-air mixture, provide under these conditions stable combustion conditions which permit a large range of variation of the combustion air ratio and ensure a practically complete oxidative conversion of the fuel.

The first layer 1 is preferably of hollow-ball mullite ceramic. With the employment of analogous aggregate sizes, grain sizes, binder quantities and binder types, manufacture can be realized also with other hollow-ball materials of the high temperature region, such as for example corundum, zirconium oxide, titanium oxide, cordierite etc.

In relation to the application in the field of combustion/exhaust gas treatment and preferably with the above-mentioned multilayer formation of the overall ceramic, a mullite ceramic of the following composition has proved to be advantageous:

Aggregate:

- hollow-ball mullite with aggregate sizes from 0.5–5 mm, preferably 0.7–1.5 mm
- $Al_2O_3$ content: 72–77 weight %; preferably: 72.9 weight %
- $SiO_2$ content: 22–27 weight %; preferably: 24.9 weight %
- Proportion in the ceramic: 75–92 weight % preferably: 78–82 weight % (referred to water-free substance)

Binder:

- mixed binder based on clay, pyrogenic silicic acid and silica sol with the main components:
- $Al_2O_3$ content: 72–80 weight %; preferably: 72–75%
- $SiO_2$ content: 19–27 weight %; preferably: 23–26%
- Proportion in the ceramic: 5–15 weight % preferably: 7–10 weight % (referred to water-free substance)
- To improve strength in the raw state there may be added to the binder in further configuration a solidifier, e.g. up to 1 weight % monoaluminiumphosphate, preferably in a fluid binder.

Supplementary Material/Filler:

- fine grain mullite with the grain size 0.15 mm preferably 0–0.08 mm, e.g. in melt mullite quality with the main components
- $Al_2O_3$ content: ca. 76 weight %
- $SiO_2$ content: ca. 23 weight %
- Proportion in the ceramic: 3–10 weight %
- (referred to water-free substance)

For the manufacture of a raw body, the binder, beginning with the mixing of the dry components, is stirred with the addition of the silica sol until an even distribution of all components has been attained. The provision of water is effected via the silica sol, if applicable additionally also by means of the phosphate liquid binder and in further configuration by means of a commercial organic thickener, such as e.g. methylcellulose, carboxymethylcellulose or hydroxyethylcellulose, which can be selectively added for improving the working consistency.

The aggregates and supplementary materials (fillers), pre-mixed dry, are continuously added to the prepared binder as the mixing procedure is continued, and further mixed until an even consistency is achieved.

Thereafter, forming is effected, preferably by shaking into a corresponding mold, by stamping or isostatic pressing. The raw body is dried for approximately 2 hours up to about 180° C. Sealing regions 14 or **14*a*, 14*b*, 14*c***, desired from flow considerations, are covered or penetrated with a slick coating of binder mixed with an increased proportion of filler. Thereafter the firing process is effected between about 1200° and 1600° C. finishing burn temperature.

The equalization of the flow resistance, described above, for improving the evenness of the outflow speed profile of exhaust gases is attained through a purposive adaptation of layer thicknesses in conjunction with the body geometry.

The second layer 2, explained above with regard to its functional effects, will be described in accordance with the invention preferably with reference to the example of a solid material reinforced mullite fiber conglomeration. Embodiments based on other crystalline (single and/or poly-crystalline) high temperature fibers or fiber mixtures, having application temperatures approximately above 1500° C., such as e.g. $Al_2O_3$ fibers with 95% $Al_2O_3$ or with more than 99.5% $Al_2O_3$, $ZrO_2$ fibers or silicon nitride fibers, are possible with the employment of corresponding colloidal solutions and fillers. The fiber diameter should preferably lie in a narrow spectrum above 3 μm. Particularly preferred are fibers with a diameter of 10 μm and larger. The fiber length should lie in the range 0–5 mm, preferably 0–3 mm.

The ceramic starting material contains crystalline (single and/or poly-crystalline) fibers or fiber mixture having the above-mentioned spectrum, e.g. polycrystalline mullite fibers with the chemical composition ca. 72 weight % $Al_2O_3$ ca. 28 weight % $SiO_2$ as main components, with a median fiber diameter ≧3 μm and a fiber length of 0–3 mm proportion in initial material: 40–80 weight % preferably 50–70 weight % (referred to water-free substance)

inorganic filler with the chemical composition, adapted to the fiber quality composition, with a grain size of 0–0.080 mm e.g. fine grain melt mullite with the chemical composition ca. 76 weight % $Al_2O_3$ ca. 23 weight % $SiO_2$ in the main components proportion in the starting material: 10–40 weight % (referred to water-free substance)

inorganic binder, preferably mixed binder, adapted to the quality of fiber and filler, of colloidal solutions/precursors of $Al_2O_3$, $SiO_2$ and $ZrO_2$ e.g. mixed binder of colloidal $Al_2O_3$ and colloidal $SiO_2$ set to a content of main ingredients of 72–95 weight % $Al_2O_3$, 28–5 weight % $SiO_2$ preferably 77 weight % $Al_2O_3$ 23 weight % $SiO_2$.

Proportion in starting material: 10–50 weight % (referred to water-free substance)

In a further configuration, the above-mentioned ceramic starting material may be supplemented by an addition of clay in an order of a 0–30 weight % (referred to the water-free ceramic starting material).

A burnout material is added to the ceramic starting material, which burnout material is preferable in fibrous or splinter form with diameter less than about 0.5 mm and a length of less than or equal to about 3 mm, e.g. in the form of artificial fiber cuts, natural fiber cuts or wood powder.

The added proportion amounts to: 30–70 weight %

(referred to the water-free starting material).

There is further added to the ceramic starting material a commercial thickener, preferably in the form of a cellulose, e.g. of the quality of methylcellulose, carboxymethylcellulose or hydroxyethylcellulose with a proportion from 0.2–5 weight % dry material (referred to the dry starting material), in a 1-percent aqueous solution.

There is further added to the ceramic starting material a material which develops gas, which together with an increasing temperature causes a driving reaction in the layer with corresponding porosification.

The relative proportion amounts to 10–30 weight %

(reactive material, referred to the water-free starting material).

For example, oxygen separation in the thermal/catalytic degradation of $H_2O_2$ can be advantageously employed as a driver reaction, whereby preferably about 10–30 percent aqueous solutions are used.

The second layer 2 can for example be produced in that a fiber cut of the above-mentioned mullite fiber, of the length 3 mm, is wet dispersed in order to gently dissolve the fibers.

To the fiber solution there is added the supplementary material which can be burned out, e.g. as wood powder (sieve undersize 0.5 mm) with an elongate splintery form, and again stirred until an even distribution is attained. Thereafter, in successive steps, there are added the inorganic filler, e.g. fine grain mullite, the binder, e.g. the $Al_2O_3$—$SiO_2$ mixed binder having 77% $Al_2O_3$ and 23% $SiO_2$, and the organic thickener, e.g. hydroxyethylcellulose in a 1 percent aqueous solution, and stirred to even dispersion. The mass is maintained below 20° C., if appropriate by cooling of the individual components. As final step, the gas developing material, e.g. $H_2O_2$ in 10 percent or preferably 30 percent aqueous solution, is added and dispersed evenly in the mass. Through the provision of water, the mass is brought to a working consistency and preferably by means of trowelling or brushing or spraying applied to the pre-fired carrier ceramic. The ceramic is dried at 40° C. for about 12 hours. Thereby there forms a uniform finely porous structure, with the desired multidirectional arrangement of fibers, as a result of the decay process of the $H_2O_2$ with the release of oxygen, induced by the solid particles together with the supply of heat. Before the application of further layers, the dried second layer 2 is preferably subject to an abrading process with which the layer thickness is set, e.g. 2 mm. An abrading process, after drying, is also advantageous for the first layer 1.

The layer 3, explained above as a flame support layer in consequence of its functional effects, will now be explained on the basis of an example of a mullite fiber conglomeration having a modified structure. A further configuration based on a fiber quality differing from that of the second layer 2, in particular towards a greater thermal loading capacity, e.g. fibers having 95% $Al_2O_3$ or 99.5% $Al_2O_3$ or more, or zirconium oxide fibers or silicon nitride fibers or fiber mixtures together with an adaptation of the oxidic filler materials and colloidal binders on the basis of $Al_2O_3$ and $ZrO_2$, are possible. The geometric requirements placed upon the fibre material, with regard to diameter and length, as described with reference to the second layer 2, apply also for the third layer 3.

The ceramic starting material of the third layer 3 is formed by crystalline (single and/or poly-crystalline) fibers or fiber mixtures of the above-mentioned spectrum, e.g. poly-crystalline mullite fibers with the chemical composition and fiber geometry described for layer 2 proportion in starting material: 20–60 weight % preferably 30–50 weight % (referred to water-free substance)

inorganic filler of the chemical composition, adapted to the composition of the fiber quality, having a grain size from 0–0.080 mm, e.g. fine grain melt mullite having the chemical composition described in relation to layer 2 proportion in starting material: 5–40 weight % preferably 10–30 weight % (referred to water-free substance)

inorganic binder, preferably mixed binder, adapted to the fiber and filler qualities, of colloidal solutions/precursors of $Al_2O_3$, $SiO_2$ and $ZrO_2$ e.g. mixed binder of colloidal $Al_2O_3/SiO_2$ as described for layer 2 proportion in starting material: 5–30 weight % preferably 10–20 weight % (referred to water-free substance)

radiatively active inorganic supplement material with a preferred grain size from 0–0.15 mm, e.g. SiC, $Cr_2O_3$, $Cr_2O_3$-spinel, $FeO_3$-spinel etc.

proportion in starting material: 20–60 weight % (referred to water-free substance)

In a further configuration there may be added to the above-mentioned ceramic starting material supplement of clay in the order of 0–10 weight % (referred to the water-free ceramic starting material)

A burn-out material, preferably in fiber or splinter form with the geometry and material configuration described for layer 2 is mixed with the ceramic starting material.

The added proportion amounts to: 30–50 weight % (referred to the water-free ceramic starting material).

There is further added to the ceramic starting material a commercial thickener of the quality described for layer 2, with a proportion of 0.1–5 weight % dry substance (referred to the water-free starting material)

in a 1 percent aqueous solution.

Further there is added to the ceramic starting material a gas developing material, in accordance with the description of layer 2, whereby the reactive proportion amounts to 1–10% reactive material (referred to the water-free ceramic starting material).

Layer 3 is produced in a manner analogous to layer 2. The dissolved fiber solution, having for example polycrystalline mullite fibers of the same length and diameter spectrum and the same chemical composition as described for layer 2 has, in the basic procedure, added to it the burn-out material—the same in terms of nature and dimensions, but varied in quantity. As solid supplementary materials there are added and worked in for example fine grain melt mullite and fine grain SiC premixed in the weight proportions described for layer 3. Analogously to layer 2, there are then for example added the above-mentioned $Al_2O_3$—$SiO_2$ binder, and thereafter the thickener, in altered weight proportions, and evenly dispersed. Reactive substance is added to the gas developing material, as in the case of layer 2 but in varied weight proportion, and up to conclusion of the drying process the ceramic is analogously processed. In further configurations, in place of the mullite fiber, another described crystalline fibre of the type $Al_2O_3$ or $ZrO_2$ etc., or a mixture of fibers with or without mullite fibers may be of advantage.

An outer surface formed by an abrading process after drying is likewise advantageous for the third layer 3. By this means the gas outflow is improved, and the layer thickness can also be set.

In an additional further configuration, the material which can be burned out may be varied in terms of its quality, e.g. artificial fiber sections of the length from about 3 mm with a diameter of smaller than about 0.5 mm.

In another further configuration, the mixed binder can be varied, in that for example a colloidal solution/precursor of $ZrO_2$ is added, which can partially or completely replace the colloidal $SiO_2$ solution.

After completion of the driver process and the drying, preferably for about 12 hours at about 40° C., the ceramic is fired, dependent upon the material composition of the layers, between about 1200° C. and 1600° C. By means of an abrading process of the outer layer 3 or if applicable also layer 2, the layer thickness is reproducibly set, for example to about 2 mm.

The concrete requirements placed by the application concerned, in particular the exhaust emission components in the case of the treatment of gaseous waste products by means of thermal oxidation, determine the choice of materials. Available supply pressure and power requirements have a decisive influence on the geometry. With knowledge of the combustion mechanism, the resistances through the three or, if appropriate even more, layer structure can be so controlled and can be so determined by means of analogous air flow trials, that the roots of the flames can be held in the ceramic of the outer layer over a wide range of power and a broad air ratio, so that a waste product leaves the burner surface which is low in NOx and almost completely free of CxHy and CO.

In burner operation, the fuel-air mixture 4 flows to and through the first layer 1. The layer thereby distributes, correspondingly to the flow resistance, the mixture as evenly as possible over the combustion surface 5 and effects a minor prewarming and aftermixing. In the layer 2, there is effected an intensification of the prewarming and a further evening of the flow profile. The mixture is brought to reaction temperature. The flame itself sits as a flame front in or directly on the layer 3 and causes this to glow. The exhaust gases flowing away are indicated by the reference sign 6.

Such a ceramic is mounted in a gas tight manner through a suitable medium supply inclusive of the fitting 7.

The burnable mixture supplied into the ceramic is ignited at the surface by means of a suitable device, the combustion exhaust gases are supplied to a combustion chamber and there is realized a more or less intensive heat take out, in dependence upon the process.

We claim:

1. A combustion support element for surface burners, said element comprising a ceramic material having a plurality of throughflow openings, said the combustion support element being a multi-layer composite body having three layers, said first layer being built up of ball-like or hollow ball-like aggregates and forms a porous conglomeration ceramic, and the second and third layer are each of a solid reinforced conglomeration of mullite fibers or other crystalline (single and/or poly-crystalline) temperature resistant fibers or fiber mixtures, the material of the second layer having a greater temperature resistance than the material of the first layer, and the third layer having a greater temperature resistance than the first and the second layer.

2. A combustion support element according to claim 1, characterised in that, the ceramic material of said first layer is a mullite ceramic.

3. A combustion support element according to claim 1, characterized in that, the ceramic material of said first layer is at least one of corundum, zirconium oxide, titanium oxide or cordierite.

4. A combustion support element according to claim 1, characterised in that, the fiber in said second and third layers diameter is at least about 3 μm, and the fiber length is no greater than about 5 mm.

5. A combustion support element according to any of claims 1, 2 or 3, characterized in that, said second and third layers are a ceramic material and there is mixed into the ceramic material of said second and third layers a fibrous or splintery burn-out material.

6. A combustion support element according to any of claims 1, 2 or 3, characterized in that, an outflow surface of at least one of the first, second and third layer is abraded.

7. A combustion support element according to any of claims 1, 2, or 3, characterized in that, the layers are of a porous ceramic material and the second layer is arranged on an outflow side of the first layer, and the third layer is arranged on an outflow side of the second layer, and in that the second layer has a higher flow resistance than the first layer and the third layer has a higher flow resistance than the second layer.

8. A combustion support element according to any of claims 1, 2 or 3, characterised in that, the second layer has a lower thermal conductivity, than the third layer.

9. A combustion support element according to any of claims 1, 2 or 3, characterised in that, the first layer is thicker than the second layer and the third layer and the second layer is thicker than the third layer, and wherein the thickness of the first layer is between about 10 and 15 mm, the thickness of the second layer is between about 1 mm and 4 mm and the thickness of the third layer is between about 1 mm and 4 mm.

10. A combustion support element according to any of claims 1, 2 or 3, characterised in that, at least one layer includes an aggregate material and a binder material.

11. A combustion support element according to any of claims 1, 2 or 3, characterised in that, at least one of the second and third layers having a material promoting heat radiation emission and having a grain size from about 0 to about 0.15 mm.

12. A combustion support element according to any of claims 1, 2 or 3, characterised in that, at least one layer other than the first layer has a material which can be burned or arranged distributed therein.

13. A combustion support element according to any of claims 1, 2 or 3, characterized in that, it is formed in one of a plate-like, disc-like and closed end sleeve-like form.

14. A combustion support element for quasi-flameless surface burners, said element comprising a ceramic material having a plurality of throughflow openings, the combustion support element is a multi-layer composite body with three layers, the first layer being formed of a ball-like or hollow ball-like aggregate which forms a porous conglomeration ceramic, at least one of the second and third layers being of a solid reinforced conglomeration of crystalline temperature resistant fibers or fiber mixtures, and the flow permeability or the flow resistance of the combustion support element in the center thereof being different from the gas flow permeability or the flow resistance in the region surrounding the center.

15. A combustion support element according to any of claims 1, 2, 3 or 14, characterized in that, the combustion support element is one of a plate-like and a disc-like form, and has a flow permeability which is lesser in its central region than in its outer region.

16. A combustion support element according to any of claims 1, 2, 3 or 14, characterized in that, it is thicker in its central region than it its outer region and its thickness continuously decreases outwardly, whereby the thickening is formed by a bulging on one side.

17. A combustion support element according to any of claims 1, 2, 3 or 14, characterized in that, the combustion support element is of a sleeve-like form and its gas permeability continuously increases in a direction towards an outflow side.

18. A combustion support element for quasi-flamless surface burners, comprising a ceramic material having a plurality of throughflow openings, the combustion support element being a multilayer composite body with three layers, the first layer being formed of aggregates which comprise a porous conglomeration ceramic, at least one other layer being of a solid reinforced conglomeration of crystalline, temperature resistant fibers or fiber mixtures, the flow permeability or the flow resistance of the combustion support element is greater in the center of the element than in the region surrounding the center, and the combustion support element is formed with at least one of a plate-like, disc-like and closed end sleeve-like form, the flow permeability of the plate-like and disc-like forms being lesser in the central region than in the outer region, and the gas permeability of the sleeve-like form being less at its closed end than in the region away from its closed end.

19. A combustion support element according to claim 18, characterised in that, in said plate-like and disk-like forms of the combustion support element, the flow resistance increases continuously outwardly by virtue of one of the permeability decreasing and the element itself being bulged on one side, and in said sleeve-like form of the combustion support element the gas flow resistance of the sleeve continuously increases towards the outflow side.

20. A combustion support element according to either claim 18 or claim 19, characterized in that, the closed end sleeve-like form has an external surface and an internal surface which converges in the direction towards the closed end thereof.

21. A combustion support element according to any of claims 1, 2, 3, 14, 18 or 19, characterized in that, said support element has a region of reduced flow permeability which is formed by means of densified regions.

22. A combustion support element according to claim 21, characterized in that, the densified regions are formed by means of an application of material which has a low gas permeability.

23. A combustion support element according to any of claims 1, 2, 3, 14, 18 or 19, characterized in that there is arranged a densified region centrally in an end face wall.

24. A combustion support element according to any of claims 1, 2, 3, 14, 18 or 19, characterized in that, the first layer has a flow permeability which is different in the center thereof than in the region around the center, and the other layers are substantially equally thick.

25. A combustion support element according to any of claims 1, 2, 3, 14, 18 or 19, characterized in that, the combustion support element includes mounting surfaces which are sealed by means of material applied thereto, and in that the mounting surfaces are arranged at the periphery and on the external surface of said layers.

26. A combustion support element according to claim 25, characterized in that, the combustion support element has a closed end sleeve-like configuration and in that a sealed region is arranged at the end thereof opposite to its closed end.

27. A combustion support element according to claim 25, characterized in that, the sealed region extends up to at least the second layer.

28. A process for the production of a combustion support element in the form of a composite body of three layers, said process comprising the steps of:

first producing an inflow side first layer, and then applying a second layer to the output side of the first layer, wherein the first layer is mixed through mixing of an aggregate material in the liquid or doughy state, molded in a mold, and then dried, thereafter applying a third layer onto the second layer and drying the second and third layers, thereafter firing the layers together as a composite body, and abrading the third layer on the outflow side of said composite body after one of the drying and firing.

29. A process according to claim 28, characterized in that, the first layer is prefired after its drying.

30. A process according to claim 28, characterized in that, for forming the first layer there is employed a conglomeration built up of ball-like or hollow ball-like aggregates.

31. A process for the production of a combustion support element according to claim 28, characterized in that, said second and third layers are a ceramic material and mixing with the ceramic material of said second and third layers, a gas developing material that, with an increased temperature, effects a driver reaction in the layer with corresponding porosification.

32. A process for the production of a combustion support element according to claim 28, characterized by mixing with the material of at least one of said layers a material which, with increasing temperature, develops gas, which increases the porosity of said one layer.

33. A process for the production of a combustion support element according to claim 28, characterized by-abrading, at least one of the first, second and the third layers on an outflow side thereof.

* * * * *